US011338326B2

(12) United States Patent
Janes et al.

(10) Patent No.: US 11,338,326 B2
(45) Date of Patent: May 24, 2022

(54) SINGLE-MASS, ONE-DIMENSIONAL RESONANT DRIVER

(71) Applicant: Resonance Technology International Inc., New Westminster (CA)

(72) Inventors: Matthew C. Janes, New Westminster (CA); Douglas Dane Reelie, Langley (CA); Stewart G. Page, Uraidla (AU)

(73) Assignee: Resonance Technology International Inc., New Westminster (CA)

( * ) Notice: Subject to any disclaimer, the term of this patent is extended or adjusted under 35 U.S.C. 154(b) by 0 days.

(21) Appl. No.: 16/841,358

(22) Filed: Apr. 6, 2020

(65) Prior Publication Data

US 2020/0316646 A1 Oct. 8, 2020

Related U.S. Application Data

(60) Provisional application No. 62/830,500, filed on Apr. 7, 2019.

(51) Int. Cl.

| | |
|---|---|
| ***B06B 1/18*** | (2006.01) |
| ***E02D 7/18*** | (2006.01) |
| ***F15B 15/14*** | (2006.01) |

(52) U.S. Cl.

CPC ..... *B06B 1/183* (2013.01); *E02D 7/18* (2013.01); *F15B 15/14* (2013.01); *B06B 2201/73* (2013.01)

(58) Field of Classification Search

CPC ..... B06B 1/183; B06B 2201/73; E02D 7/18
See application file for complete search history.

(56) References Cited

U.S. PATENT DOCUMENTS 2,238,116 A 4/1941 Kelly
3,509,948 A * 5/1970 Pierre ..... E02D 7/18 173/44

(Continued)

FOREIGN PATENT DOCUMENTS

JP 56025518 3/1981
RU 2335352 12/2005

(Continued)

*Primary Examiner* — Kenneth Bomberg
*Assistant Examiner* — Matthew Wiblin
(74) *Attorney, Agent, or Firm* — Madson IP, P.C.

(57) ABSTRACT

An efficiency-enhanced resonant system is provided with a backing mass connected to a linear vibrator, a parasitic mass connected to the linear vibrator, a positioning spring, a connecting device, and external biasing springs. The linear vibrator provides vibrating force to the parasitic mass which is connected to the connecting device, grasping a working implement. The use of separate positioning spring and external biasing springs accommodates a tuned system that balances the reduction in backing mass movement, avoids backing mass resonance within the working range of frequencies, and maintains a minimized linear vibrator stroke within the optimal range for one-dimensional implements within desired frequency ranges. The linear vibrator provides vibration that manifests as a frequency range of the natural frequency of the combined assembly of the parasitic mass, positioning spring, external biasing springs, connecting device, and implement, so that the resonant system efficiently performs work with minimized wasted energy.

20 Claims, 5 Drawing Sheets

(56) References Cited

U.S. PATENT DOCUMENTS

| | | | | | |
|---|---|---|---|---|---|
| 3,678,803 | A * | 7/1972 | Schwenzfeier | B06B 1/183 91/39 |
| 4,317,406 | A * | 3/1982 | Takahashi | B06B 1/183 91/39 |
| 4,650,008 | A * | 3/1987 | Simson | E02D 7/18 173/91 |
| 5,136,926 | A * | 8/1992 | Bies | B06B 1/183 60/459 |
| 5,168,938 | A * | 12/1992 | Sano | E02D 7/18 173/11 |
| 5,974,800 | A | 11/1999 | Scheidl et al. | |
| 7,162,944 | B2 | 1/2007 | Britz | |
| 10,947,689 | B2 * | 3/2021 | Kocher | E02D 7/20 |
| 2011/0240323 | A1 | 10/2011 | Winkes | |

FOREIGN PATENT DOCUMENTS

| | | |
|---|---|---|
| WO | 2005056201 | 6/2005 |
| WO | WO2011087080 | 7/2011 |

* cited by examiner

SINGLE-MASS, ONE-DIMENSIONAL RESONANT DRIVER

RELATED APPLICATION

This patent application claims the benefit of U.S. Provisional Patent Application, Ser. No. 62/830,500 that was filed on Apr. 7, 2019, for an invention titled SINGLE-MASS, ONE-DIMENSIONAL RESONANT DRIVER, which is incorporated herein by this reference as if recited in its entirety.

TECHNICAL FIELD

The present disclosure describes a resonant vibrator for use in industrial and construction applications. More specifically, the resonant vibrator of this disclosure uses a tuned and optimized dominant mass and biasing spring to enable pure, or near pure, resonant behavior within a connector and linear, one-dimensional object. The nature of the vibrator mass, biasing springs (internal and external), and connector profoundly affect the operating efficiency and longevity of the mechanism.

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "some embodiments," "various embodiments," and the like, may indicate that the embodiment(s) of the invention so described may include a particular structure, feature, property, or characteristic, but not every embodiment necessarily includes the particular structure, feature, property, or characteristic. Further, repeated use of the phrase "in one embodiment," or "in an exemplary embodiment," does not necessarily refer to the same embodiment, although they may.

BACKGROUND

Vibratory equipment is used in construction applications to compact earth, concrete or asphalt, drill into or insert piles into the earth, extract piles or fluidize beds in industrial applications. Typically, a rotating eccentric mass vibrator is used to generate the vibration and a brute horsepower means is used to perform the work. In these cases, the method relies on power to accelerate, decelerate and reverse the direction of the implement or pile through each cycle. The work conducted to accelerate, decelerate and re-accelerate the combined mass of the dynamic portion of the mechanism and the implement is wasted with each cycle. The work conducted on the earth by moving or crushing the earth to achieve compaction, inserting a pile, advancing a drill bit, or the like requires significant energy over and above the energy required to simply vibrate the mechanism and the implement.

For example, current vibratory pile drivers use high-powered eccentric mass mechanisms to accelerate both the eccentric mass mechanism (housing, eccentric masses, shafts and motors) and the pile, as a rigid object, up and down in order to advance the pile into the earth. Further, they require heavy clamp systems to connect to the pile, which represent additional mass that must be accelerated up and down. Overall, the dynamically excited mass ("dynamic mass"), comprises a housing, eccentric masses, shafts, motors, and a clamp connection, and represents a significant fraction, or perhaps the majority, of the entire mass that must be accelerated upward and downward with each cycle. The dynamically excited mass further represents wasted, or unrecovered energy, not used for work.

Accordingly, a need exists for a new system and method to perform vibratory work that is more efficient and reduces the amount of energy wasted in accelerating and decelerating a dynamic mass and implement.

Due to the inefficiencies discussed above regarding vibratory pile drivers and the like, a system is desired that reduces the amount of energy required to mobilize the mass of an implement; and thus, consume less total energy to complete the work desired. Resonant mechanisms or systems offer a method to recover and store the dynamic mass and implement energy (similar to a pendulum) which otherwise would be expended by a conventional eccentric vibratory system. Such resonant systems effectively may turn a one-dimensional elastic object into an axial, oscillating spring. The one-dimensional object may be a pile, a drill string, a chisel or the like. See U.S. Pat. No. 5,136,926, issued to Bies et al., for a general description of a known resonant system.

With such resonant systems, the energy required to be added to the system is that energy used to conduct the work as opposed to the sum of the energy to mobilize the dynamic mass, the implement and conduct the work.

Known single-mass, resonant mechanisms use a velocity source vibrator exciting a one-dimensional object against a single, dominant (backing) mass, separated by a biasing spring to generate a highly efficient work energy. Such devices offer increased available power at the end of the one-dimensional object for devices such as breakers, pile drivers and drills. By exciting the one-dimensional object at its axial resonant frequency, great efficiencies are realized to generate high acceleration and amplitude of the one-dimensional object ends. Work is performed when the motion of the one-dimensional object end is interrupted (impact) and the mass of the moving one-dimensional object end is decelerated.

A resonant, vibrational frequency is a natural frequency which for a given one-dimensional object, in the axial direction, represents free oscillation in elongation and contraction. In terms of stress, the system acts as a longitudinal spring oscillating from tension into compression with each cycle.

When reference is made to a resonant frequency of a one-dimensional object, in the context of this disclosure, there will be a prominent or very dynamic resonant frequency which incorporates the half wavelength, or a half-wavelength multiple, natural frequency of the one-dimensional object.

The resonant frequency required is a natural frequency which is determined by the characteristics of the combination of the dynamic mass and the implement (such as a pile or drill tube). The resonant frequency is also influenced by factors such as the spring system used to apply a force to the mechanism for control or to bias in the direction of work. Indeed, the natural frequency is also influenced by the interaction of the soil or rock through friction or end resistance as the soil or rock degenerates or breaks. If a poorly designed mass and spring are attached to the vibrating mechanism, this may negatively influence the system by changing the natural frequency, creating competing or parasitic resonant mechanisms or cause phase fluctuations that degrade drivability.

A vibrational frequency required for resonance will not be known necessarily in advance, although some estimates of the required frequency range may be determined. In addition, given geometries (lengths, cross sections and densities) of implements, tampers, chisels or rollers may be desired which will affect the overall natural frequency of the system. However, such frequency will be well defined about some specific frequency. By tuning the applied vibration to this specific, pure real frequency, the greatest degree of efficiency and production will be achieved. The desire then is to achieve the delivery of vibratory energy into the system with minimum disruption of the pure real nature of the mass-loaded, one-dimensional system.

A problem occurs when a linear vibration generator, or velocity source, is fixed to the mass-loaded one dimensional object for the purpose of delivering energy. The velocity source vibrator requires a dominant mass against which to push as, all force or action has an equal and opposite force or reaction. Further, the velocity source vibrator requires a positioning biasing spring between the dominant mass and the vibrating element to permit safe operation and handling of the device.

Ideally, in order to minimize the contamination of the pure real natural frequency of the combined added mass and one-dimensional implement, the dominant mass should be infinite and the biasing spring should be infinitely flexible. However, handling and manipulation of the mechanism demands that the overall mass be minimized and the biasing spring be as stiff as possible. As a result, the necessity for efficient handling and manipulation contaminates the pure real natural frequency of the combined added mass and one-dimensional implement, thereby compromising the efficiency of the system.

To make use of a one-dimensional object in vibration for the purpose of conducting work, there must be some attachment (or clamp) made to the implement and an introduction of vibratory force. Any such attachment involves the rigid attachment of additional mass to the dynamic system, contributing to the dynamic mass. Any non-rigidly attached mass will either be too flexible and represent a loss of efficiency or slip and result in a friction weld. The addition of the mass to the end of a one-dimensional implement will shift the vibration movement and enhance the potential for work at the end or tip of the implement opposite the added mass. See Pile-Driving Method and Vibration Control Method, Australian Patent No. AU 2011206031 for an explanation of the enhancement of a mass-loaded rod.

Importantly, the mass, impedance and geometry of the vibrational mechanism, which includes the biasing spring and the backing mass, may have a distinct and detrimental effect upon the resonant frequency, amplitude and the benefit or work achieved by the combined added mass and one-dimensional implement system. For example, decreasing the mass and impedance of the backing mass, will allow the vibrator to expend a greater portion of the vibration energy developed to move the backing mass instead of move the dynamic mass and one-dimensional implement. This results in reduced movement and energy available for work within the one-dimensional implement. Similarly, increasing the stiffness of the biasing spring increases the movement of the backing mass and robs the one-dimensional implement of motion and energy available for work. Further, the presence of a backing mass and biasing spring will induce a shift in the resonant frequency of the combined mass and one-dimensional implement and could induce subordinate natural frequencies that interfere with tuning of the system to the desired pure natural frequency of the combined mass and one-dimensional implement system.

Tuning of the vibrator to the natural frequency of the dynamic mass and one-dimensional implement system is critical to achieve high efficiency and production. See U.S. Pat. No. 5,136,926, issued to Bies et al., that describes a system and method to tune a velocity source vibrator to the natural frequency of a pure resonant system.

A piston cylinder mechanism requires an internal (position) biasing of the piston or cylinder towards the center of the stroke in order to ensure the apparatus does not drift in one direction or the other and result in contact of the parts under high dynamic motion. Such contact may result in repeated impacting of the components and subsequent damage. Similarly, the application of an external biasing force may cause the piston or cylinder to drift from center of stroke in the direction of the bias. Such force would be applied by a machine or worker in the direction of the implement motion to enhance the effect of the work. Any type of machine or structure or a person that provides suitable suspension of the resonant system may exert the external biasing force on the system. For example, a person, a crane, a back hoe, a tripod, a cantilevered beam, or any other type of known suspension structure may push downward on a vibrator to increase the speed at which a pile is driven. Similarly, the internal biasing spring may be used when the external biasing force is applied to maintain the piston/cylinder position within the central region of the stroke and ensure the dynamic motion does not occur within the end of the allowable stroke, causing internal component damage.

Tuning of the spring requires selection of a spring stiffness to minimize the drift of the piston or cylinder under natural discrepancies in the flow of the mobilizing fluid, typically hydraulic fluid or compressed air, or any similar medium. Principal factors in selecting spring stiffness are: 1) the size of the implement, and 2) the size and capability of the base machine, crane, back hoe, or the like used to suspend the system for movement and driving. However, the spring must not offer up a resonance in the backing mass with respect to the operating frequency of the mechanism. Similarly, the spring must be stiff enough to minimize the drift of the stroke of the piston or cylinder under a biasing load. Given the biasing load may be quite large, such as applied by a drill, pile driver or back hoe when inserting a pile, crushing rock or compacting soil, the spring must be quite stiff and the drift of the piston or cylinder under full biasing load may be quite large. The operation and efficiency of the mechanism may be further complicated by the compressibility of the fluid medium used to power the piston cylinder system under high frequency cyclic loading.

SUMMARY OF THE INVENTION

The embodiments of the present disclosure have been developed in response to the present state of the art, and in particular, in response to the problems and needs in the art that have not yet been fully solved by currently available vibratory systems.

Each exemplary single-mass, two-spring resonant system of the present invention comprises a linear vibrator, a backing mass with a positioning, biasing spring separate from external force biasing springs, a parasitic mass, a connection device, and a linear implement. The backing mass is connected to a linear piston-cylinder-style velocity source, vibratory mechanism. The backing mass includes known components such as a manifold, a protective housing, support mechanisms, and hydraulic easements. The positional biasing spring is connected to and between the backing mass and the parasitic mass. The vibratory source, such as a linear vibrator, is also connected to and between the backing mass and the parasitic mass.

The parasitic mass is attached to the connection device (such as a clamp) which integrally connects to the one-dimensional or linear implement that serves as the working implement, such as a pile, a drill tube, a chisel, or the like. The external biasing spring is distinct from the positional biasing spring and is connected to and between the piston/cylinder linear vibrator (via the parasitic mass) and an external flexible connection (such as a hoisting hook or other) used to suspend the resonant system and transfer a biasing force.

For the purposes of this disclosure, the term "spring" is intended to be interpreted expansively and can be defined as an elastic member, whose main function is to deflect under the action of a load and recovers its original shape when the load is removed. Any number of types, sizes, material make up, or shapes of springs having various properties and capabilities (such as, by way of example only, stiffness, adjustable stiffness, compression, extension, etc.) may be suitable for use within the spirit of this invention. The types of springs depicted in the drawings schematically are not intended to limit the type or number of springs used, but rather merely serves as an example of the type of spring that may be used. Those skilled in the art will understand that different types, sizes, types of materials, combinations of types or materials, or shapes may be suitable for use within the scope of the invention disclosed and claimed herein.

The linear vibrator comprises a housing, pressure chambers, fluid conduits to deliver and return a fluid medium between the pressure chambers, a piston/cylinder assembly (one or other of the piston or cylinder is fixedly connected to the backing mass and the other of which is free to axially reciprocate slidably to move the implement), and a servo or spool valve (not shown in the drawings, but known to those skilled in the art) capable of redirecting flow within the piston/cylinder assembly between the pressure chambers. The piston/cylinder assembly geometry is configured to minimize the volume of the opposing pressure chambers.

Further, for the purposes of this disclosure, the term "implement" is intended to be interpreted expansively and can be defined as any linearly working implement that has been or may in the future be attached to, secured to, or manipulated by a vibratory force supplying mechanism (including, but not limited to, vibratory pile drivers and resonant systems). Such working implements may include, but are not limited to, piles (as depicted in the exemplary schematic drawings herein); drill bits, tubes, and strings; compaction feet, plates, and rollers; plows; chisels; bull-nosed and rock crushers; pulverizers; and the like.

Under high frequency cyclic loading, the fluid medium is pumped into and out of each pressure chamber at twice the frequency of the operation of the mechanism (once for each up and down stroke). The rapid flow reversal requires the fluid medium to be alternately highly compressed during the power stroke and decompressed during the exhaust stroke of each cycle. Thus, with each cycle the fluid undergoes alternating compression and decompression with associated deflection proportional to its elastic modulus. As the frequency increases, the amount of fluid pumped into the chamber must be increased to maintain a given amplitude of vibration. This volume of flow must also account for the compression of the fluid residing within the cylinder as it begins the power cycle at the termination of the return cycle. This compression effort increases as the volume of the pressure chamber increases and at higher frequencies (above 30 Hz), may dominate the work conducted by the available compression fluid flow.

It has been found that the efficiency of the system is improved considerably through minimization of the volume of the pressure chambers. Too large a pressure chamber volume will result in high movement due to compression; and thus, wasted work, which is subsequently released via decompression during the decompression cycle and results in heat production, which is detrimental to the overall hydraulic system efficiency. However, a large cylinder stroke (and thus pressure chamber volume) is required to accommodate the stroke of both the internal spring (center-restoring spring) function and the delivery of a biasing force should they be delivered through a single biasing spring. Further, external biasing causes translation of the cylinder with respect to the piston and resulting differential in the pressure and return volumes on either side of the piston or cylinder shoulder. Subsequent power strokes thus have highly different efficiencies, due to fluid compressibility; and thus, differing stroke lengths and power. This offset causes further translation inefficiency and increased reliance on the spring for internal biasing of the cylinder position to account for uneven stroke.

Again, for the purposes of this disclosure, the term "fluid" or "fluid medium" is intended to be interpreted expansively and can be selected from known fluids to provide particular properties or capabilities. Because various fluid properties may have an impact on different performance functions, the viscosity of the fluid may be a key element. The fluid viscosity affects hydraulic systems in several ways; namely for example, volumetric efficiency (efficiency in relation with volume loss due to internal leakages), mechanical efficiency (efficiency in relation with mechanical loss due to internal friction), (elasto)hydrodynamic and boundary lubrication, cavitation, heat dissipation, air release, filterability, and compressibility. Consequently, the type of fluid to be used may be selected from a group of known fluids to be suitable for use in the resonant systems of the present invention. The type of mobilizing fluid selected is a component of the ability to tune the resonant systems of the present invention, such fluids may be any number of known hydraulic fluids (organic, non-organic, blends, etc.) or compressed air, or any similar medium. Those skilled in the art, armed with the disclosures herein, will understand how to select a suitable fluid and how to tune the system as a result of the fluid selected.

The separation of spring functions for a single-mass resonant system into the positioning biasing spring (internal) and the external biasing spring enables the reduction of the total volume of a pressure cavity (comprising two pressure chambers) to reduce the impact of fluid medium compression. Also, this equilibrates the respective volumes of the pressure and return cavities to reduce offset efficiency; and thus, even out the pressure and return strokes.

Through separation of the biasing spring functions, a significantly more efficient system is achieved. In an exemplary embodiment of the invention, a single, internal (positioning) biasing spring may be situated between the moving piston or cylinder and the backing mass. This positioning biasing spring resists the biasing of the backing mass, only, due to gravity and prejudices the system to center of stroke (i.e., the midpoint between the apex of the upward stroke and the foot of the downward stroke) when the working implement is connected to the system, which optimizes the efficiency of the system when driving the implement. Also, the positioning biasing spring further prejudices the system to center of stroke should an uneven flow of pressurizing fluid occur. This positioning biasing spring is tuned to prevent resonance of the backing mass at any operating frequency and does not have to provide added stiffness for external biasing. Thus, the positioning biasing spring may be highly flexible relative to the external biasing spring, reducing the contamination of the pure real nature of the resonated system.

The separate and independent external biasing spring is positioned between a parasitic mass connected to the movable portion of the piston or cylinder and a frame (of any suitable type and not limited to the representative bar schematically depicted in the drawings, for such frame may also have balance and centering functions in addition to the its suspension function) used to deliver the external biasing force. Thus, the external biasing force is delivered directly to the vibration source (via the parasitic mass) and does not pass through the backing mass or internal positioning biasing spring; and therefore, does not influence the volume of the pressure chambers of the linear vibrator. When the vibration source is biased by the external force, through the eternal biasing spring, the linear vibrator mechanism simply moves under the action of the force and the internal bias spring ensures the backing mass remains positioned centrally within the stroke of the mechanism. The internal stroke of the piston/cylinder mechanism is not affected by the external bias. Thus, the original cylinder stroke demonstrated by known resonant systems, that was previously required to be long in order to accommodate the stroke required for both centralizing and biasing, may now be significantly shorter, providing only the stroke required for the centralizing function for the exemplary embodiments of the single-mass, two-spring resonant system of the present invention. Through this decrease in pressure chamber volume, the efficiency of the equipment is increased substantially because the magnitude of fluid compression and decompression during each cycle is substantially reduced.

These and other features of the present disclosure will become more fully apparent from the following description, or may be learned by the practice of the invention as set forth hereinafter.

BRIEF DESCRIPTION OF THE DRAWINGS

The exemplary embodiments of the present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are representative and are provided so that this disclosure will be operative, enabling, and complete. Accordingly, the particular arrangements disclosed are meant to be illustrative only and not limiting the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Understanding that these drawings depict only exemplary embodiments and are, therefore, not to be considered limiting of the invention's scope, the exemplary embodiments of the invention will be described with additional specificity and detail through use of the accompanying drawings in which.

Figure 1:
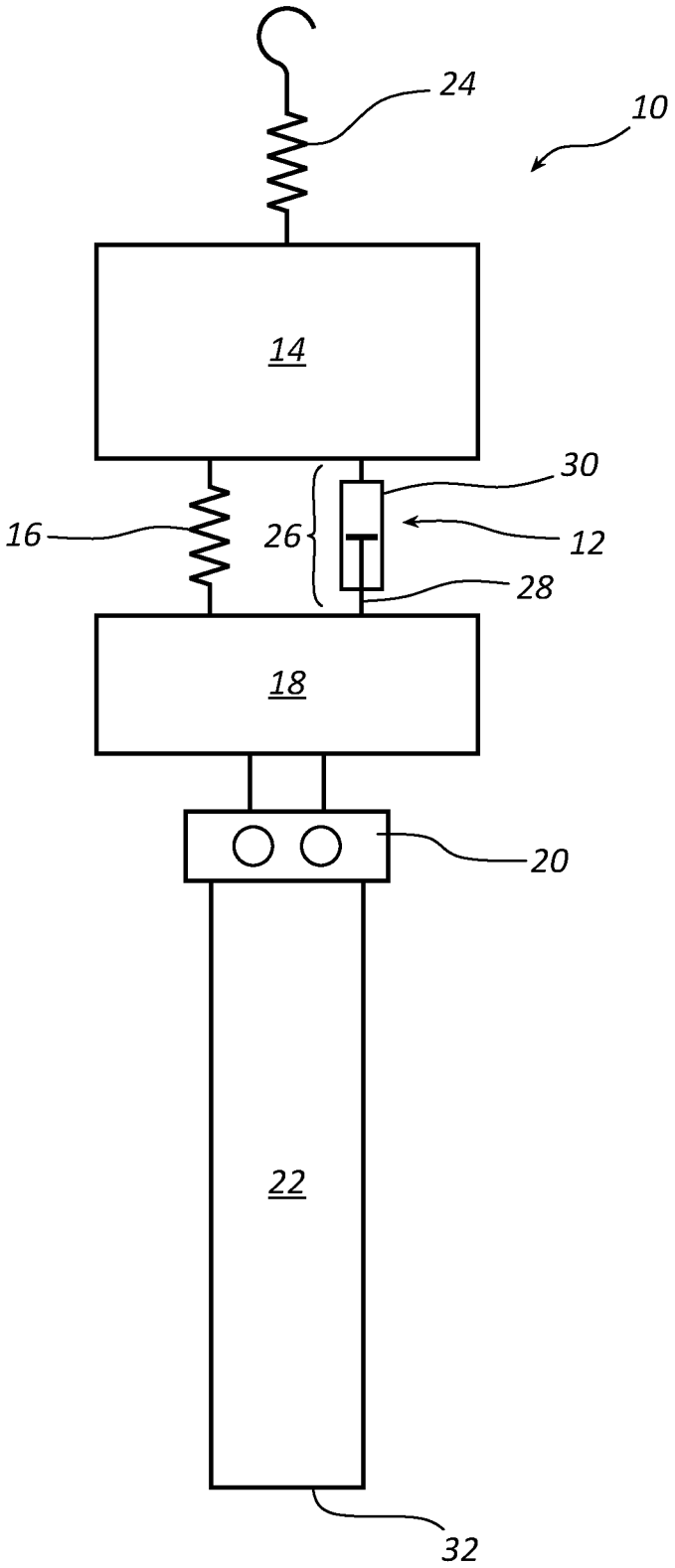
FIG. 1 (Prior Art)
FIG. 1 is an elevation diagram of a schematic configuration of a current state of the art resonant system showing the system's main components, spring configuration, connector, and an exemplary pile.

REFERENCE NUMERALS resonant system 10
vibratory source or linear vibrator 12
backing mass 14
(internal, positional) biasing spring 16
parasitic mass 18
connection device 20
linear or one-dimensional implement 22
flexible connection 24
piston/cylinder assembly 26
piston 28
cylinder 30
distal tip 32
(external, force) biasing springs 34
biasing force F (directional arrows)
external flexible connection 36
pressurized medium seals 38
upper pressure chamber 40
lower pressure chamber 42
hydraulic medium 44
frame 46

DETAILED DESCRIPTION

The exemplary embodiments of the present disclosure will be best understood by reference to the drawings, wherein like parts are designated by like numerals throughout. It will be readily understood that the components, and their equivalents, of the exemplary embodiments, as generally described and illustrated in the Figures herein, could be arranged and designed in a wide variety of different configurations. Thus, the following more detailed description of the exemplary embodiments, as represented in the Figures, is not intended to limit the scope of the invention, as claimed, but is merely representative of exemplary embodiments of this disclosure.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Additionally, the terms "operator", "user", and "individual" may be used interchangeably herein unless otherwise made clear from the context of the description.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

In this application, the phrases "connected to", "coupled to", and "in communication with" refer to any form of interaction between two or more entities, including mechanical, capillary, electrical, magnetic, electromagnetic, pneumatic, hydraulic, fluidic, and thermal interactions.

The phrases "attached to", "secured to", and "mounted to" refer to a form of mechanical coupling that restricts relative translation or rotation between the attached, secured, or mounted objects, respectively. The phrase "slidably attached to" refer to a form of mechanical coupling that permits relative translation, respectively, while restricting other relative motions. The phrase "attached directly to" refers to a form of securement in which the secured items are in direct contact and retained in that state of securement.

The term "abutting" refers to items that are in direct physical contact with each other, although the items may not be attached together. The terms "grip" and "grasp" refer to items that are in direct physical contact with one of the items firmly holding the other. The term "integrally formed" refers to a body that is manufactured as a single piece, without requiring the assembly of constituent elements. Multiple elements may be integrally formed with each other, when attached directly to each other from a single work piece. Thus, elements that are "coupled to" each other may be formed together as a single piece.

FIG. 1 (labeled as prior art) depicts a conventional state of the art resonant system 10 comprising a vibratory source 12, such as a linear vibrator 12, a backing mass 14, with a single, (connective and positional) biasing spring 16, a parasitic mass 18, a connection device 20 (such as a clamp, clevis, socket, threaded engagement, eye and pin assembly, and any other type of device known to connect a working implement to a vibrating mass), and a linear implement 22. The backing mass 14 is connected to a base machine, crane, back hoe, or any suitable suspension structure using a flexible connection 24, through which a push or pull may be exerted. Also attached to the backing mass 14 is the velocity, vibratory source, linear vibrator 12, comprising a piston-cylinder-style velocity source, vibratory mechanism, referred to herein as the piston/cylinder assembly 26. The backing mass 14 typically includes a manifold, protective housing, support mechanisms, and hydraulic easements that are not depicted specifically in the drawings so to simplify the description of the resonant system 10 and so not to obscure components pertinent to understanding the resonant system 10. Although the manifold, protective housing, support mechanisms, and hydraulic easements are not shown, they are known to those skilled in the art. Also, although the connection device 20 is represented schematically in the drawings, it should be understood that the connection device 20 should be interpreted as including any and all known structures that connect a working implement to a vibrating mass, including but not limited to a clamp, clevis, socket, threaded engagement, eye and pin assembly, and the like.

The biasing spring 16 is connected to and between the backing mass 14 and the vibratory, parasitic mass 18. The vibratory source (such as a linear vibrator) 12 is also connected to and between the backing mass 14 and the parasitic mass 18. In turn, the parasitic mass 18 is connected to the connection device 20 which grasps and secures the one-dimensional implement 22 serving as a working implement such as a pile, drill tube, or the like. Plumbing or other control (such as hydraulic lines) may be connected through the base machine to the backing mass 14 as well.

Figure 2:
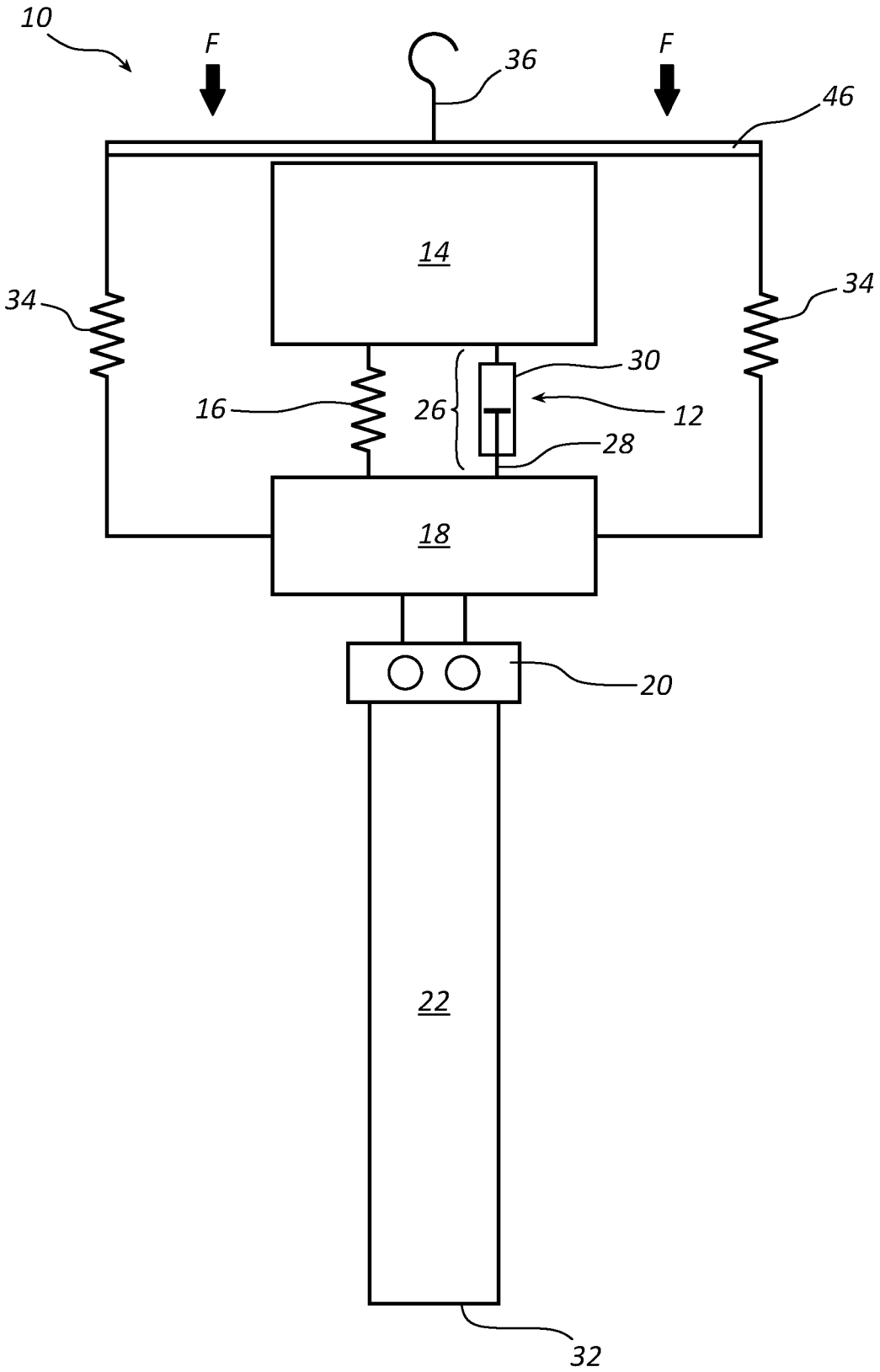
FIG. 2 is a side elevation diagram of a schematic configuration of an exemplary embodiment of a single-mass, two-spring resonant system of the present invention showing the exemplary system's main components, separate biasing springs, the connector, and an exemplary pile.
Figure 5:
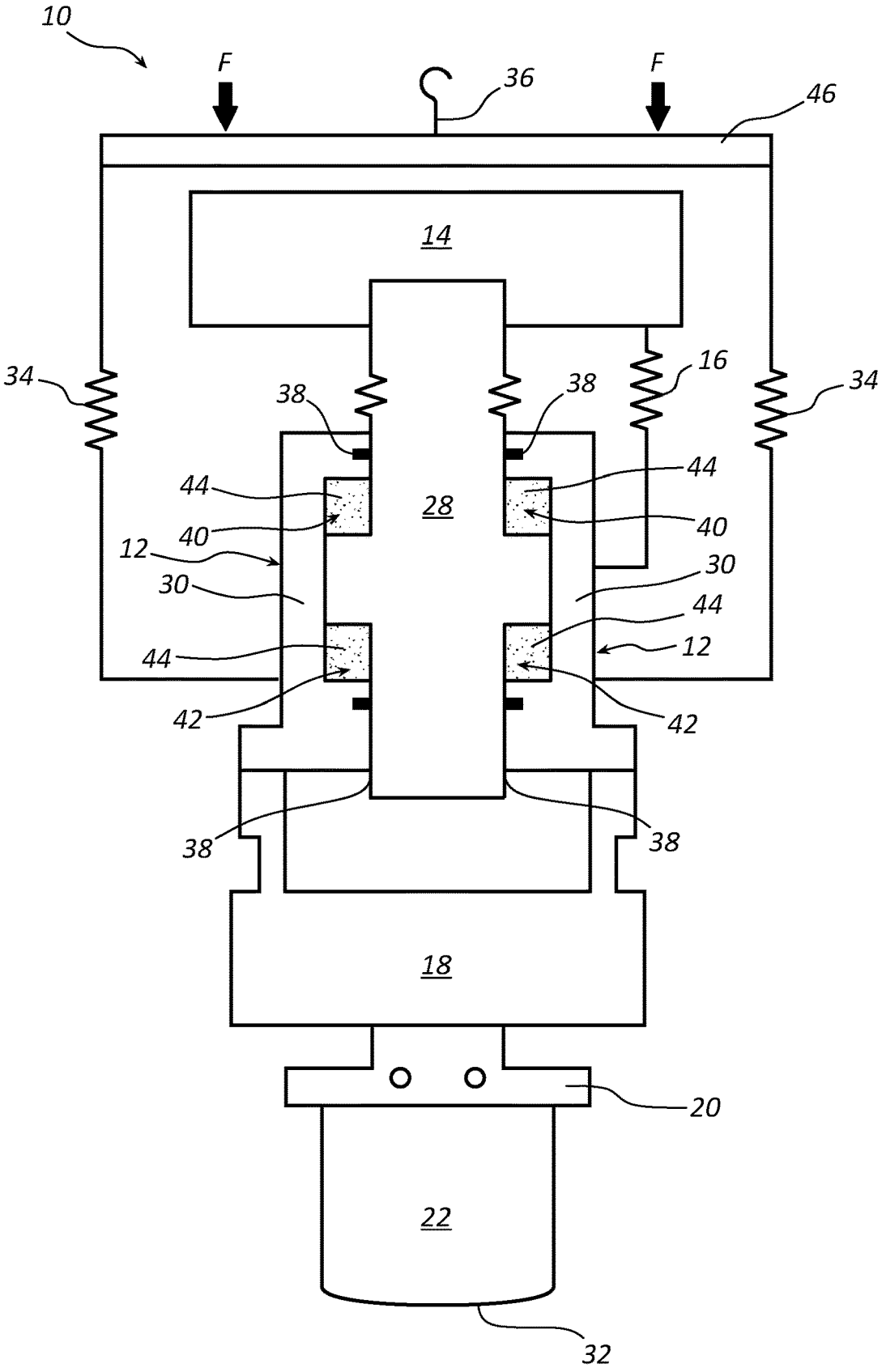
FIG. 5 depicts a section diagram of the schematic configuration of the piston and cylinder resonant system having a shorter stroke wherein the piston moves about the center of stroke as closely as possible as a result of using separate springs for internal (positioning) biasing and external (force) biasing.

The linear vibrator 12 comprises a piston/cylinder assembly 26. Either of the piston 28 or cylinder 30 is attached to the backing mass 14 and considered "stationary" or "more stationary;" while the other of the piston 28 or cylinder 30 which is considered "movable" and is connected to the implement 22 via the parasitic mass 18. For example, if the cylinder 30 is attached to the backing mass 14 (as shown in FIG. 2), then the piston 28 moves up and down relative to the backing mass 14 and excites the parasitic mass 18, the connection device 20 and the implement 22. Alternatively, if the piston 28 is attached to the backing mass 14 (as shown in FIG. 5), then the cylinder 30 moves up and down relative to the backing mass 14 and excites the parasitic mass 18, the connection device 20 and the implement 22. It should be understood that either the piston 28 or the cylinder 30 of the piston/cylinder assembly 26 may be attached to the backing mass 14 and the other moves and excites the implement 22.

FIG. 1 depicts the geometry and interaction of the main components of the single-mass resonant system 10. The interaction of the components governs the system's natural frequency and reaction to loads; and thus, the operation, tuning and efficiency of the system 10. The magnitude of the backing mass 14 and its relationship with the single, positional biasing spring's 16 stiffness influences the acceleration and displacement of the implement 22 and the backing mass 14 under vibration. Any movement of the backing mass 14 is at the expense of opposite movement of the combined assembly of the parasitic mass 18, connection device 20, and one-dimensional implement 22.

It is the movement of the distal tip 32 of the one-dimensional implement 22 opposite to the backing mass 14 that achieves work (compaction, pile driving, or drilling, for example). Maximizing the backing mass 14 and minimizing the biasing spring's 16 stiffness will result in the maximum movement of the implement 22 and the least influence upon the pure real natural frequency of the combined assembly comprising the parasitic mass 18, connection device 20, and one-dimensional implement 22 and maintains the effectiveness of the available tuning systems. However, increasing the backing mass 14 of the equipment is undesirable, as it results in large, unwieldy equipment that is difficult and expensive to handle and maneuver during operation. Similarly, a weak biasing spring 16 will result in large displacements of the piston 28 or cylinder 30 during biasing of the mechanism during operation, where biasing refers to pushing, pulling or adding force to the direction of motion to enhance work.

Users desire the smallest and lightest equipment possible in order to gain efficiency and ease of handling. This desire suggests minimizing the dominant, backing mass 14 and maximizing of the stiffness of the connective biasing spring 16. The reduction of the backing mass 14 and increasing the stiffness in the connective biasing spring 16 results in an increase in the contamination of the pure real natural frequency of the system, causing an increase in the backing mass 14 movement, which reduces the one-dimensional implement's 22 equal and opposite movement and work efficiency. In addition, a more flexible biasing spring 16 requires a longer working stroke of the piston/cylinder assembly 26 under biased operation.

Figure 3:
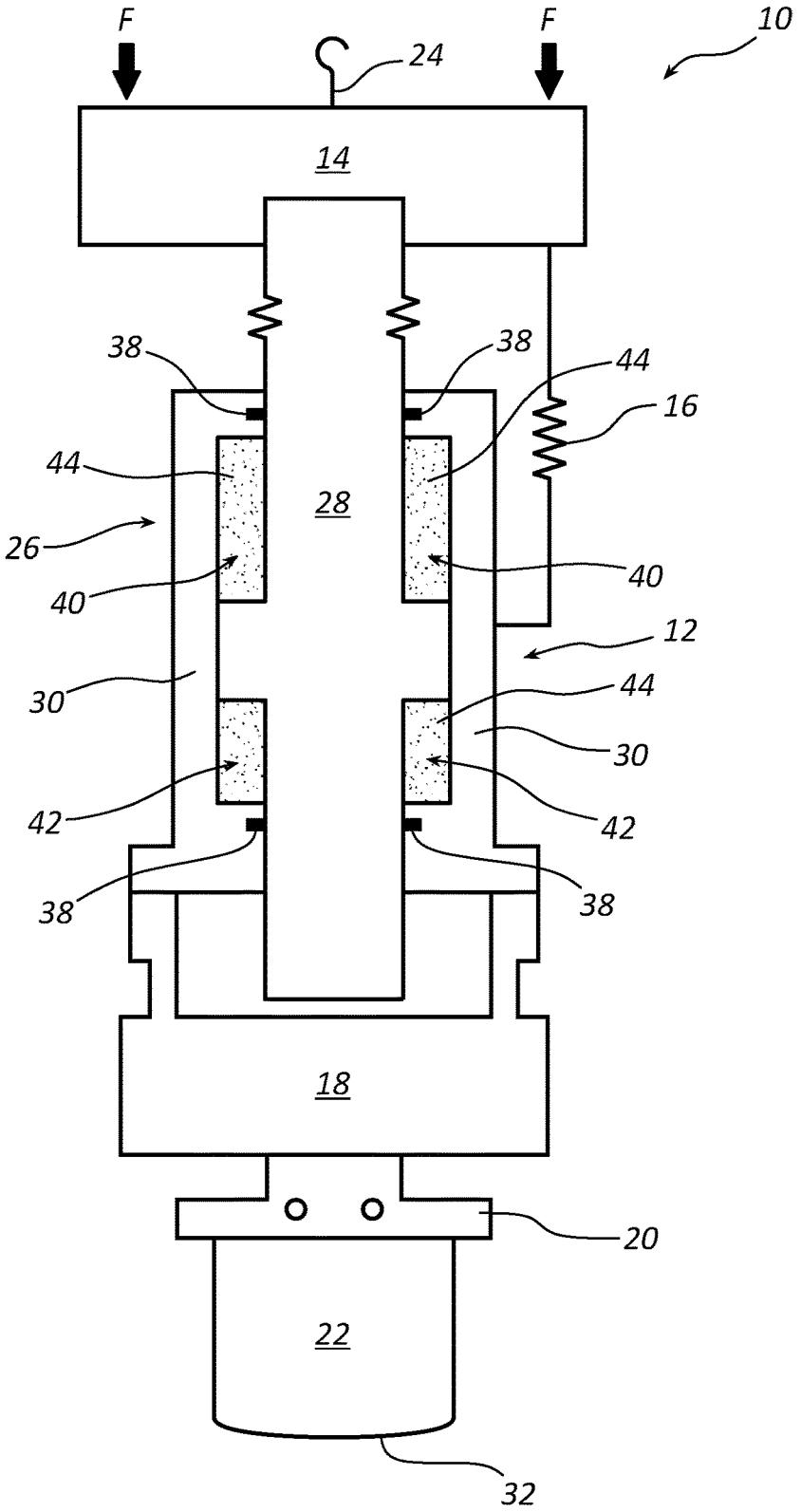
FIG. 3 (Prior Art)
FIG. 3 is a section diagram of the schematic configuration of a piston and cylinder resonant system showing the long stroke as required when using a single spring used for both functions of backing mass centralizing and external force biasing, depicting the result of downward force onto the flexible and backing mass.
Figure 4:
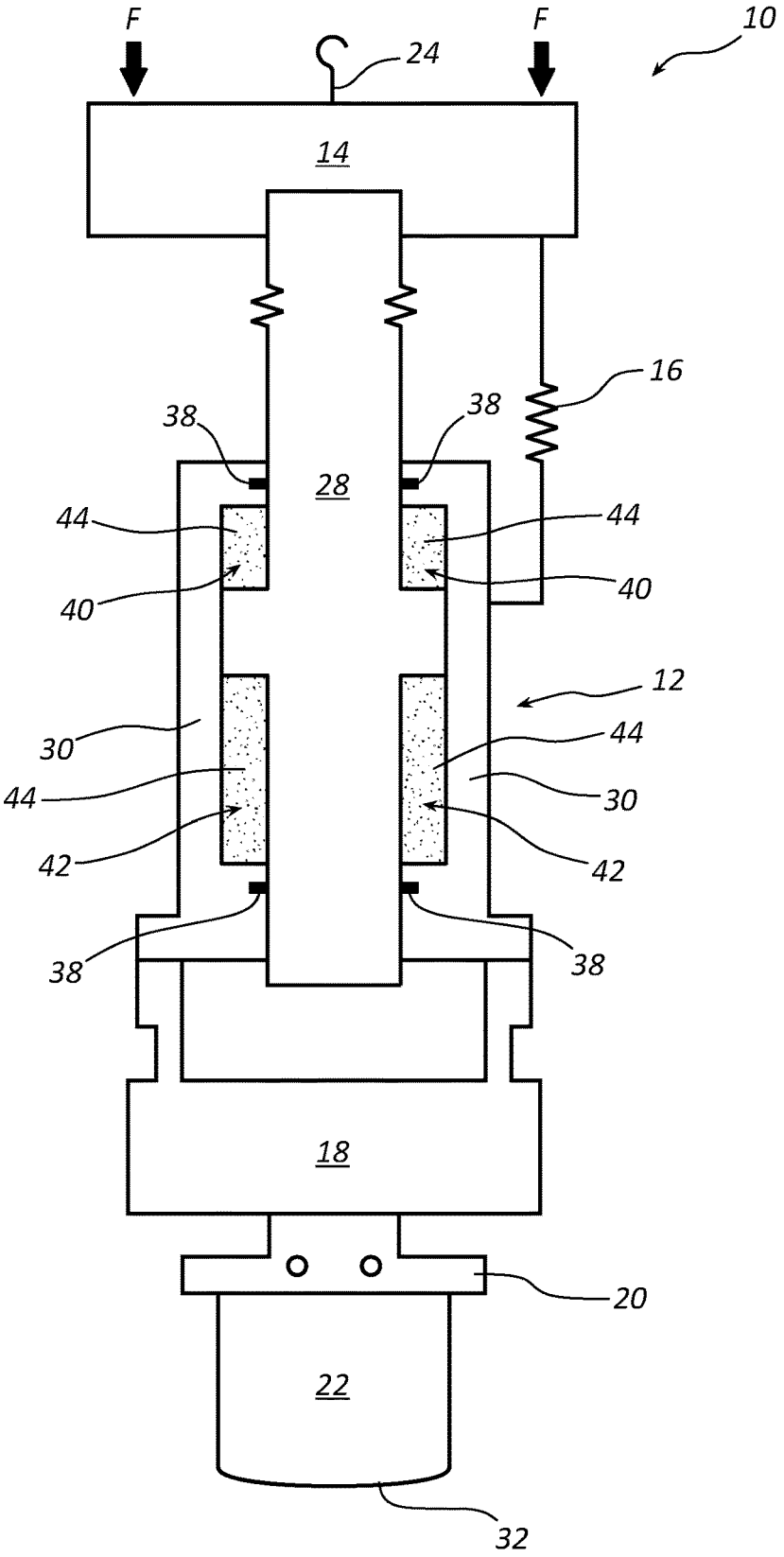
FIG. 4 (Prior Art)
FIG. 4 is a section diagram of the schematic configuration of the piston and cylinder resonant system of FIG. 3 showing the return stroke as required when using a single spring used for both functions of backing mass centralizing and external force biasing, and depicting the result of an equivalent upward load creating opposite geometry within the resonant system.

The single-mass, two-spring resonant system 10 of the invention, resolves the issues experienced with the known resonant systems 10 (shown in FIGS. 1, 3, and 4). FIG. 2 depicts an exemplary embodiment of a single-mass, two-spring resonant system 10 of the invention, comprising a linear vibrator 12, a backing mass 14, separate and distinct springs (namely, an internal (positional), biasing spring 16 and a pair of external biasing springs 34), and a connection device 20 for grasping and connecting to a linear implement 22. The backing mass 14 is attached to a linear-piston-cylinder-style, vibratory source 16. The positional biasing spring 16 is connected to and between the backing mass 14 and the parasitic mass 18. The vibratory source 12, such as a linear vibrator 12, is also connected to and between the backing mass 14 and the parasitic mass 18. The parasitic mass 18 is attached to the connection device 20 (e.g., a clamp) which grasps and secures the one-dimensional implement 22, that serves as a working implement such as a pile, drill tube, chisel, or the like. Each external biasing spring 34 is connected to and between the piston/cylinder, linear vibrator 12 (via the parasitic mass 18) and an external flexible connection 36 (hoisting hook or other) used to suspend the resonant system 10 and transfer a biasing force F. It should be noted that while flexible connection 24 connects to the backing mass 14, flexible connection 36 does not.

FIG. 2 depicts the geometry and interaction of the main components of the single-mass, two-spring resonant system 10. The interaction of the components governs the system's natural frequency and reaction to loads; and thus, the operation, tuning and efficiency of the system 10. The magnitude of the backing mass 14 and its relationship with the stiffness of the single, positional biasing spring 16 influences the acceleration and displacement of the implement 22 and the backing mass 14 under vibration. Any movement of the backing mass 14 is at the expense of opposite movement of the combined assembly of the parasitic mass 18, connection device 20, and one-dimensional implement 22. It is the movement of the distal tip 32 of the one-dimensional implement 22 opposite to the backing mass 14 that achieves work (compaction, pile driving, or drilling, for example).

As noted above, maximizing the backing mass 14 and minimizing the stiffness of the biasing spring 16 will result in the least influence upon the pure real natural frequency of the combined assembly of the parasitic mass 18, connection device 20, and one-dimensional implement 22 and maintains the effectiveness of the available tuning systems. Again, however, increasing the mass of the equipment is undesirable as it results in large, unwieldy equipment that is difficult and expensive to handle and maneuver during operation. In this exemplary embodiment, a weaker (i.e., less stiff) biasing spring 16 is permissible because no external biasing force F is to be translated into the backing mass 14. An exemplary positional biasing spring 16 with low stiffness allows for high isolation of the backing mass 14, and the least contamination of the pure real natural frequency of the combined assembly of the parasitic mass 18, connection 20, and implement 22. A soft (weaker, less stiff) positional biasing spring 16 will also minimize the transfer of the reciprocating force delivered by the piston/cylinder, linear vibrator 12 to the backing mass 14; and thus, maximize the force translated to the parasitic mass 18, connection 20 and implement 22. Stiff external force biasing springs 34 efficiently transfer biasing loads to increase production.

Tuning of the dominant mass 14, biasing spring 16, vibratory source 12 to minimize the influence upon the combined vibratory, parasitic mass 18, connection device 20 and the expected or working range of one-dimensional implements 22 results in equipment optimized for the target use.

The present embodiments indicate the separation of the internal (positional) biasing spring 16 and the external, biasing spring 34 will accommodate a tuned system that balances the reduction in backing mass 14 movement, avoids backing mass 14 resonance within the working range of frequencies, and maintains a minimized linear vibrator 12 stroke within the optimal range for one-dimensional implements 22 within desired frequency ranges.

FIG. 3 (labeled as prior art) depicts a conventional linear oscillator system 10 using a single-biasing spring 16. The backing mass 14 is fixedly connected, in this example, to the linearly actuated piston 28. The linearly actuated cylinder 30 slidably engages piston 28 with pressurized medium seals 38 acting to enclose upper and lower pressure chambers 40, 42. The volumes of pressure chambers 40, 42 are expanded and contracted when external forces are exerted through the flexible connector 24 connected to the backing mass 14 and the biasing spring 16. Cylinder 30 is fixedly connected to the parasitic mass 18, the connector 20 and the implement 22.

FIG. 3 also depicts the result of a downward force bias F onto flexible connector 24 and the backing mass 14 via some external means, for example a crane, a backhoe or a worker. The downward external force bias F results in translation of the piston 28 downward with respect to the cylinder 30 which resists movement due to the work required or external resistance upon the implement 22. The resulting translation of the piston 28 downward with respect to the cylinder 30 reduces the volume of the lower pressure chamber 42 and increases the volume of the upper pressure chamber 40.

The reciprocating linear vibrator 12 now possesses uneven volumes in the upper 40 and lower 42 pressure chambers. Assuming for the purposes of this disclosure that the position of the piston 28 depicted in FIG. 3 reflects the end position of a downward stroke of the linear actuator 12 and the beginning of an upward stroke, pressurization of the upper chamber 40 has occurred and will begin to lift the cylinder 30 upwards, beginning an upward stroke. The currently depicted unpressurised hydraulic medium 44 within the upper pressure chamber 40 becomes pressurized as the cylinder 30 moves toward the end of the return stroke. The pressurized hydraulic medium 44 being introduced must compress the unpressurised hydraulic medium 44 within the upper chamber 40; and thus, will lose otherwise available stroke by an amount equal to the height of the upper chamber 40 multiplied by the pressure differential of the existing and introduced hydraulic medium 44, divided by the elastic modulus of the hydraulic medium 44.

The compression of the fluid 44 represents wasted work which is unrecoverable as it is released upon evacuation of the fluid medium 44 at the end of the pressure stroke when the chamber vents to the return circuit. The energy is lost as heat which is inefficient. The subsequent cycle will translate the cylinder 30 downward by introducing pressurized hydraulic medium 44 into the lower pressure chamber 42. Note the lower pressure chamber 42 is significantly smaller in volume than the upper chamber 40, due to the downward external biasing force F, even following the last reciprocating cycle. The pressurized medium 44 must, similarly, compress the low pressure hydraulic medium 44 currently residing in the lower pressure chamber 42; and thus, will lose otherwise available stroke by an amount equal to the height of the lower chamber 42 multiplied by the pressure differential of the existing and introduced hydraulic medium 44, divided by the elastic modulus of the hydraulic medium 44. In this case, because the volume of the lower chamber 42 is smaller than the upper pressure chamber 42 less displacement will occur and thus less wasted work will occur during this compression. The result is that a reciprocating bias occurs with more translation of the cylinder 30 downward with each cycle that occurs on the subsequent upward cycle. The end of the upward cycle is depicted in FIG. 4.

Similarly, during the next stroke further uneven work, stroke and losses will occur which must be accommodated for by the system 10. This unequal stroke and work may be accommodated in a number of ways but will result in additional wasted work and losses in the system 10.

FIG. 4 (labeled as prior art) depicts that under an equivalent upward external biasing load, an equal but opposite geometry occurs with an equal but opposite loss built into the system 10 due to uneven stroke magnitude and work.

FIG. 5 depicts another exemplary embodiment of the single-mass, two-spring resonant system 10 of the present invention, using two, separated biasing springs 34. The backing mass 14 is fixedly connected, in this exemplary embodiment, to the linearly actuated piston 28. The linearly actuated cylinder 30 slidably engages piston 28 with pressurized medium seals 38 acting to enclose upper and lower pressure chambers 40, 42. External forces are exerted through the flexible connector 36 connected to the external force biasing springs 34 via a frame 46 used to deliver the external biasing force F. As a result, the pressure chambers 40, 42 are not affected by the introduction of the external biasing force F upwards or downwards. Cylinder 30 is fixedly connected to the parasitic mass 18, the connector 20 and the implement 22.

Of course, it should be understood that a differing geometry could be used in another exemplary embodiment. For example, the cylinder could be fixedly attached to the backing mass 14 and the piston 28 could be fixedly attached to the parasitic mass 18. Those skilled in the art will understand what affect this will have on the resonant system.

FIG. 5 depicts the result of a downward force bias onto flexible connector 36 and the cylinder 30 via some external means (not shown), for example a crane, a backhoe or a worker. The downward external force bias F on flexible connector 36 results in a translation of the cylinder 30 downward with respect to the piston 28. However, positional biasing spring 16 reacts to the downward biasing translation by exerting a force downward on the backing mass 14 and equilibrates the force by translating the backing mass 14 downwards an appropriate distance to eliminate the biasing force F in the positional biasing spring 16 and slidably re-centering the piston 28 relative to the cylinder 30 to the center of stroke position. The resulting translation of the piston 28 downward with respect to the cylinder 30 maintains relatively equivalent volumes within the upper pressure chamber 40 and the lower pressure chamber 42.

Further the external biasing of the resonant system 10 did not result in a change in stroke of the cylinder 30 slidably upon the piston 28 and thus did not change the upper 40 and lower 42 pressure chamber volumes. The stroke of the cylinder 30 slidably upon the piston 28 need only accommodate the reciprocating motion of the linear actuator 12 and not the combined motion of the linear actuator 12 and the biasing. As a result, the pressure chamber volumes may be made significantly shorter with less volume.

The reciprocating linear vibrator 12 possesses smaller, more even volumes in the upper 40 and lower 42 pressure chambers. Assuming for the purposes of this disclosure that the position of the piston 28 depicted in FIG. 5 reflects the end position of a downward stroke of the linear actuator 12 and the beginning of an upward stroke. As depicted, pressurization of the upper chamber 40 has occurred and will begin to lift the cylinder 30 upwards, beginning an upward stroke. The currently depicted unpressurised hydraulic medium 44 within the upper pressure chamber 40 becomes pressurized as the cylinder 30 moves toward the end of the return stroke. The pressurized hydraulic medium 44 being introduced must compress the unpressurised hydraulic medium 44 within the upper chamber 40; and thus, will lose otherwise available stroke by an amount equal to the height of the upper chamber 40 multiplied by the pressure differential of the existing and introduced hydraulic medium 44, divided by the elastic modulus of the hydraulic medium 44.

When the upper pressure chamber 40 volume is small, this loss is proportionally reduced and the linear actuator 12 is more efficient and delivers a longer stroke and conducts more work. The reciprocating work stroke is typically a fraction of the available pressure chamber stroke; and thus, the difference in the upper pressure chamber 40 volume and the lower pressure chamber 42 volume is small.

The subsequent cycle will translate the cylinder 30 downward by introducing pressurized hydraulic medium 44 into the lower pressure chamber 42. Note, the lower pressure chamber 42 is now only slightly smaller in volume that the upper chamber 40, on the order of 10% to 20%, following the last reciprocating cycle. The pressurized medium 44 must, similarly, compress the low pressure hydraulic medium 44 currently residing in the lower pressure chamber 42; and thus, will lose otherwise available stroke by an amount equal to the height of the lower chamber 42 multiplied by the pressure differential of the existing and introduced hydraulic medium 44, divided by the elastic modulus of the hydraulic medium 44. In this case, because the volume of the lower chamber 42 has become only 10% to 20% smaller than the upper pressure chamber 40, only slightly more displacement will occur, which is easily made up by the positional biasing spring 16 or other means.

FIG. 5 also depicts that under an equivalent upward external biasing load an equal but opposite geometry occurs.

For exemplary methods or processes of the invention, the sequence and/or arrangement of steps described herein are illustrative and not restrictive. Accordingly, although steps of various processes or methods may be shown and described as being in a sequence or temporal arrangement, the steps of any such processes or methods are not limited to being carried out in any specific sequence or arrangement, absent an indication otherwise. Indeed, the steps in such processes or methods generally may be carried out in different sequences and arrangements while still falling within the scope of the present invention.

Additionally, any references to advantages, benefits, unexpected results, preferred materials, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Exemplary embodiments of the present invention are described schematically above. No element, act, or instruction used in this description should be construed as important, necessary, critical, or essential to the invention unless explicitly described as such. Although only a few of the exemplary embodiments have been described schematically in detail herein, those skilled in the art will readily appreciate that schematic components are exemplary and representative of various known components that function similarly and that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under Section 112 is not intended. Additionally, it is not intended that the scope of patent protection afforded the present invention be defined by reading into any claim a limitation found herein that does not explicitly appear in the claim itself.

While specific embodiments and applications of the exemplary embodiments have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A resonant system for operating an implement to perform work, and for being suspended from an external biasing force source, the resonant system comprising:

a backing mass;

a linear vibrator having a securement end and a movable end, the securement end of the linear vibrator being connected to the backing mass;

a parasitic mass free to vibrate, the movable end of the linear vibrator being connected to the parasitic mass, the parasitic mass being connected to a connecting device for grasping and securing the implement;

a positioning spring being connected to and between the backing mass and the parasitic mass, the positioning spring having a spring stiffness that facilitates achieving a frequency range of a natural frequency for a combined assembly;

an external, flexible connection engaging the external biasing force source for suspending the resonant system and translating the external biasing force;

a frame being connected to and suspended from the external, flexible connection;

at least one external biasing spring being connected to and between the linear vibrator and the frame;

the combined assembly comprising the parasitic mass, the positioning spring, each external biasing spring, the connecting device, and the implement; and wherein the linear vibrator delivers vibrations at the frequency range of the natural frequency for the combined assembly.

2. The resonant system of claim 1 wherein the linear vibrator comprises a piston/cylinder assembly, the piston/cylinder assembly comprises a piston and a cylinder, the piston being connected to the securement end of the linear vibrator that fixedly attaches to the backing mass, the cylinder being connected to the movable end of the linear vibrator that fixedly attaches to the parasitic mass.

3. The resonant system of claim 1 wherein the linear vibrator comprises a piston/cylinder assembly, the piston/cylinder assembly comprises a piston and a cylinder, the cylinder being connected to the securement end of the linear vibrator that fixedly attaches to the backing mass, the piston being connected to the movable end of the linear vibrator that fixedly attaches to the parasitic mass.

4. The resonant system of claim 1 wherein the external, flexible connection is not attached to the backing mass.

5. The resonant system of claim 1 wherein the resonant system is tunable to the frequency range of the natural frequency for the combined assembly by adjusting the spring stiffness of the positioning spring such that the frequency range delivered by the linear vibrator accommodates a size of the implement and a size and capability of the external biasing force source for movement and driving of the implement.

6. A resonant system for operating an implement to perform work, and for being suspended from an external biasing force source, the resonant system comprising:

a backing mass;

a linear vibrator, the linear vibrator comprises a piston/cylinder assembly, the piston/cylinder assembly comprises a piston and a cylinder, the piston being fixedly attached to the backing mass, the piston and cylinder defining an upper pressure chamber and a lower pressure chamber;

a parasitic mass free to vibrate, the cylinder being movable and being connected to the parasitic mass, the parasitic mass being connected to a connecting device for grasping and securing the implement;

a positioning spring being connected to and between the backing mass and either of the cylinder and the parasitic mass. the positioning spring having a spring stiffness that facilitates achieving a frequency range of a natural frequency for a combined assembly;

an external, flexible connection engaging the external biasing force source for suspending the resonant system and translating the external biasing force, the external, flexible connection is not attached to the backing mass;

a frame being connected to and suspended from the external, flexible connection;

at least two external biasing springs each being connected to and between the frame and either of the cylinder or the parasitic mass;

the combined assembly comprising the parasitic mass, the positioning spring, each external biasing spring, the connecting device, and the implement and wherein the linear vibrator delivers vibrations at the frequency range of the natural frequency for the combined assembly.

7. The resonant system of claim 6 further comprising a fluid medium disposed within the upper pressure chamber and the lower pressure chamber.

8. The resonant system of claim 7 wherein movement of the cylinder relative to the piston causes the fluid medium to pressurize within the lower pressure chamber and the fluid medium to depressurize within the upper pressure chamber when the cylinder moves toward the backing mass and defines an upward displacement equal to the distance of the movement of the cylinder relative to the piston and lifting the parasitic mass.

9. The resonant system of claim 8 wherein the upward displacement of the cylinder relative to the piston results in a volume change of fluid medium in the lower pressure chamber of 10% to 20% from the beginning to the end of the upward displacement.

10. The resonant system of claim 7 wherein movement of the cylinder relative to the piston causes the fluid medium to pressurize within the upper pressure chamber and the fluid medium to depressurize within the lower pressure chamber when the cylinder moves away from the backing mass and defines a downward displacement equal to the distance of the movement of the cylinder relative to the piston and lowering the parasitic mass.

11. The resonant system of claim 10 wherein the downward displacement of the cylinder relative to the piston results in a volume change of fluid medium in the upper chamber of 10% to 20% from the beginning to the end of the upward displacement.

12. The resonant system of claim 6 wherein the resonant system is tunable to the frequency range of the natural frequency for the combined assembly by adjusting the spring stiffness of the positioning spring such that the frequency range delivered by the linear vibrator accommodates a size of the implement and a size and capability of the external biasing force source for movement and driving of the implement.

13. A resonant system for operating an implement to perform work, and for being suspended from an external biasing force source, the resonant system comprising:

a backing mass;

a linear vibrator, the linear vibrator comprises a piston/cylinder assembly, the piston/cylinder assembly comprises a piston and a cylinder, the cylinder being fixedly attached to the backing mass, the piston and cylinder defining an upper pressure chamber and a lower pressure chamber;

a parasitic mass free to vibrate, the piston being movable and being connected to the parasitic mass, the parasitic mass being connected to a connecting device for grasping and securing the implement;

a positioning spring being connected to and between the backing mass and either of the piston and the parasitic mass. the positioning spring having a spring stiffness that facilitates achieving a frequency range of a natural frequency for a combined assembly;

an external, flexible connection engaging the external biasing force source for suspending the resonant system and translating the external biasing force, the external, flexible connection is not attached to the backing mass;

a frame being connected to and suspended from the external, flexible connection;

at least two external biasing springs each being connected to and between the frame and either of the piston or the parasitic mass;

the combined assembly comprising the parasitic mass, the positioning spring, each external biasing spring, the connecting device, and the implement and wherein the linear vibrator delivers vibrations at the frequency range of the natural frequency for the combined assembly.

14. The resonant system of claim 13 further comprising a fluid medium disposed within the upper pressure chamber and the lower pressure chamber.

15. The resonant system of claim 14 wherein movement of the piston relative to the cylinder causes the fluid medium to pressurize within the lower pressure chamber and the fluid medium to depressurize within the upper pressure chamber when the piston moves toward the backing mass and defines an upward displacement equal to the distance of the movement of the piston relative to the cylinder and lifting the parasitic mass.

16. The resonant system of claim 15 wherein the upward displacement of the piston relative to the cylinder results in a volume change of fluid medium in the lower pressure chamber of 10% to 20% from the beginning to the end of the upward displacement.

17. The resonant system of claim 14 wherein movement of the piston relative to the cylinder causes the fluid medium to pressurize within the upper pressure chamber and the fluid medium to depressurize within the lower pressure chamber when the piston moves away from the backing mass and defines a downward displacement equal to the distance of the movement of the piston relative to the cylinder and lowering the parasitic mass.

18. The resonant system of claim 16 wherein the downward displacement of the piston relative to the cylinder results in a volume change of fluid medium in the upper pressure chamber of 10% to 20% from the beginning to the end of the upward displacement.

19. The resonant system of claim 13 wherein the resonant system is tunable to the frequency range of the natural frequency for the combined assembly by adjusting the spring stiffness of the positioning spring and adjusting the vibration frequency delivered by the linear vibrator to accommodate the size of the implement and the size and capability of the external biasing force source for movement and driving of the implement.

20. The resonant system of claim 19 wherein the resonant system comprises a single positioning spring and tuning to the frequency range of the natural frequency for the combined assembly comprises changing the stiffness of the single positioning spring.

* * * * *